US006173796B1

(12) United States Patent
McLeod

(10) Patent No.: US 6,173,796 B1
(45) Date of Patent: Jan. 16, 2001

(54) SLEEVE FOR ORIENTATING A TOOL

(75) Inventor: Gavin T. McLeod, Bull Creek (AU)

(73) Assignee: DHT Technologies LTD, Perth (AU)

( * ) Notice: Under 35 U.S.C. 154(b), the term of this patent shall be extended for 0 days.

(21) Appl. No.: 09/077,094

(22) PCT Filed: Oct. 25, 1996

(86) PCT No.: PCT/AU96/00674

§ 371 Date: May 19, 1998

§ 102(e) Date: May 19, 1998

(87) PCT Pub. No.: WO97/19249

PCT Pub. Date: May 29, 1997

(30) Foreign Application Priority Data

Nov. 22, 1995 (AU) ..... PN6739

(51) Int. Cl.[7] ..... E21B 10/64

(52) U.S. Cl. ..... 175/257; 166/117.5

(58) Field of Search ..... 175/246, 247, 175/248, 257, 258, 259, 260, 261; 166/117.5, 117.6; 285/118, 264, 265, 39

(56) References Cited

U.S. PATENT DOCUMENTS

| | | | | |
|---|---|---|---|---|
| 1,597,143 | | 8/1926 | Carter . | |
| 1,659,769 | * | 9/1928 | Dodds | 175/261 |
| 3,306,377 | | 2/1967 | Johnson . | |
| 4,023,630 | | 5/1977 | Perkin et al. . | |
| 4,177,867 | * | 12/1979 | Entner | 175/400 |
| 4,440,222 | * | 4/1984 | Pullin | 166/117.5 |
| 4,651,837 | | 3/1987 | Mayfield . | |
| 4,834,185 | | 5/1989 | Braddick . | |
| 5,662,182 | | 9/1997 | McLeod et al. . | |
| 5,862,859 | * | 1/1999 | Speed et al. | 166/117.5 |

FOREIGN PATENT DOCUMENTS

| | | |
|---|---|---|
| 2115455 | 9/1983 | (GB) . |
| 0 399 890 | 11/1990 | (WO) . |

* cited by examiner

*Primary Examiner*—Eileen D. Lillis
*Assistant Examiner*—Sunil Singh

(57) ABSTRACT

A sleeve (10) comprises a cylindrical member (12) provided at one end (14) with a pair of opposing tapered peaks (16) and (18). Peak (16) is higher (longer) than peak (18). Sleeve (10) is retained within a drive sub (26) of a ground drill and is constrained to move linearly along the drive sub (26). The peaks (16) and (18) cooperate with latch dogs (20) and (22) which are evenly spaced about and extend radially from a running tool (24). When the running tool (24) travels down the drive sub (26) and enters the sleeve (10), one of the latch dogs (20, 22) will strike one of the peaks (16) and (18) causing the tool (24) to rotate toward a predetermined rotational position. Because the peaks (16) and (18) are at different heights, latch dogs (20) and (22) cannot simultaneously contact the very top of each peak (16) and (18). If latch dog (20) strikes the top of peak (16), it will then slide down one of the sides of that peak causing the tool (24) to rotate. Memo other latch dog (22) will then contact an opposite or most distant side of the peak (18). This ensures that latch dogs (20) and (22) cannot slide down adjacent sides of the peaks which would cause the tool (24) to jam.

20 Claims, 3 Drawing Sheets

SLEEVE FOR ORIENTATING A TOOL

FIELD OF THE INVENTION

The present invention relates to a sleeve for orientating a tool and in particular, but not exclusively, for orientating a running tool of a drilling system into a predetermined rotational position.

BACKGROUND OF THE INVENTION

It is sometimes necessary, for example in the drilling industry, to orientate one part of a system into a predetermined angular position relative to another part of that system. For example, in the Applicant's SYSTEM FOR IN SITU REPLACEMENT OF CUTTING MEANS FOR A GROUND DRILL described in International application no. PCT/AU94/00322 (WO 94/29567) a bit locking sleeve is used to orientate a tool in a predetermined angular position relative to a drive sub connected with a lower end of a core barrel. The bit locking sleeve described in WO 94/29567 is in the form of a cylindrical tube with a pair of opposing peaks extending from one end. The tool is used for carrying bit segments to and from the drive sub and is provided with latch dogs which extend radially from the body of the tool. When the tool is lowered through the core barrel, the latch dogs contact the side faces of the peaks causing the tool to rotate about its longitudinal axis relative to the drive sub. The purpose for this is to correctly align the tool with seats and splines formed in the drive sub so that the bit segments carried by the tool can be properly located in the drive sub.

Field trials of the above system have proved very successful. Nevertheless, it is thought that there is a potential for jamming to occur between the tool and the locking sleeve. This arises because the latch dogs in the tool are provided with a small degree of play. As a result of this, if the latch dogs were to strike the very top of both peaks at the same time, there is a possibility that both latch dogs will slide to the same side of each peak causing the tool to become jammed. In order to avoid jamming, it is critical to ensure that on every occasion the latch dogs slide on opposing sides of each peak.

SUMMARY OF THE INVENTION

The present invention was developed with a view to substantially reducing the likelihood of jamming occurring between the locking sleeve and tool of the above-mentioned system. However, it is to be understood that the present invention has application in systems other than those used in the drilling industry.

According to the present invention there is provided a sleeve for orientating a tool travelling through said sleeve into one of one or more predetermined rotational positions, said tool provided with at least one abutment surface, said sleeve comprising:

a substantially cylindrical member provided at one end with two or more tapered peaks extending in the axial direction of said cylindrical member, one of said peaks being higher than all other peaks;

whereby, in use, when a tool provided with at least one abutment surface travels through said sleeve, one of said abutment surfaces can contact said one peak and slide along one side of said one peak causing said tool to rotate about a longitudinal axis of said cylindrical member to orientate said tool toward said predetermined rotational position and wherein any other abutment surface can contact respective other peaks on a side distant said one side.

The number and width of the peaks is dependent on the number of predetermined rotational positions that the tool can take as well as the number of abutment surfaces (eg. latch dogs) on the tool. If there is only one protrusion on the tool for contacting the peaks then, to ensure correct angular alignment of the tool the sleeve can have one peak of a width of just less than 360°, of $P_N$ peaks of $P_W$ width where $P_N$ is the number of allowable predetermined positions and $P_W$ is slightly less than 360° divided by $P_N$. For example, if the tool can take one of four (evenly spaced) predetermined positions and the tool has only one latch dog the sleeve can be provided with four peaks each of about 90° width. In the same example, if the tool has two evenly spaced latch dogs the sleeve can be provided with either two peaks each of about 180° width, or three or four peaks each of about 90°. In this example one peak should be higher than the others. Again in the same example if the tool has four evenly spaced latch dogs then the sleeve can be provided with one, two, three or four peaks each of a width of about 90°. The actual number and width of the peaks is not a critical aspect of the invention and can be varied to suit the application at hand and prevailing working conditions. What is important however is that when there is more than one peak on the sleeve, one of those peaks be higher than all others. It is advantageous but, as indicated above, by necessary, that the number of peaks be the same as the number of latch dogs/abutment surfaces provided on the tool.

Preferably said sleeve further comprises a land formed at a lowest point of each of said one or more peaks, each of said lands being adapted to receive respective ones of said abutment surfaces.

Preferably said lowest points are at the same level.

Preferably said sleeve is adapted for retention within a tubular member through which said tool can travel.

Preferably said sleeve is further provided with guiding means for guiding said sleeve to move linearly in the direction of said longitudinal axis of said tubular member while preventing rotation of said sleeve relative to said tubular member.

Preferably said guide means comprises one of a rail and channel formed on an outer peripheral surface of said sleeve, and the other of said rail and channel formed on an inner circumferential surface of said tubular member.

Preferably said sleeve further comprises releasable locking means for releasably locking said sleeve in at least one position relative to said tubular member so as to resist movement of said sleeve in an axial direction away from said at least one position.

Preferably said releasable locking means comprises at least one groove formed circumferentially about said outer circumferential surface of said sleeve and a radially resiliently expandable ring-like device adapted for retention in a circumferential groove formed in the inner circumferential surface of said tubular member, said ring-like device configured to sit proud of said inner circumferential surface when in a relaxed state;

whereby, in use, when said sleeve is moved linearly to a position where one of the grooves on the sleeve coincides with the groove on the tubular member, said ring-like device is partially seated in both grooves thereby locking said sleeve in said position.

Preferably the grooves on said sleeve are provided with sloping side surfaces leading from said outer peripheral surface to a base of said groove so that when said tool impacts on said sleeve, said ring-like device can be progressively expanded by said sloping side surfaces so that said ring-like device is moved out of said groove in said sleeve allowing said sleeve to move linearly along said tubular member.

Preferably the grooves in said tubular member have square or stepped sides to prevent the escape of said ring-like device therefrom.

BRIEF DESCRIPTION OF THE DRAWINGS

Embodiments of the present invention will now be described by way of example only with reference to the accompanying drawings in which.

DETAILED DESCRIPTION 0F PREFERRED EMBODIMENTS

Figure 1:
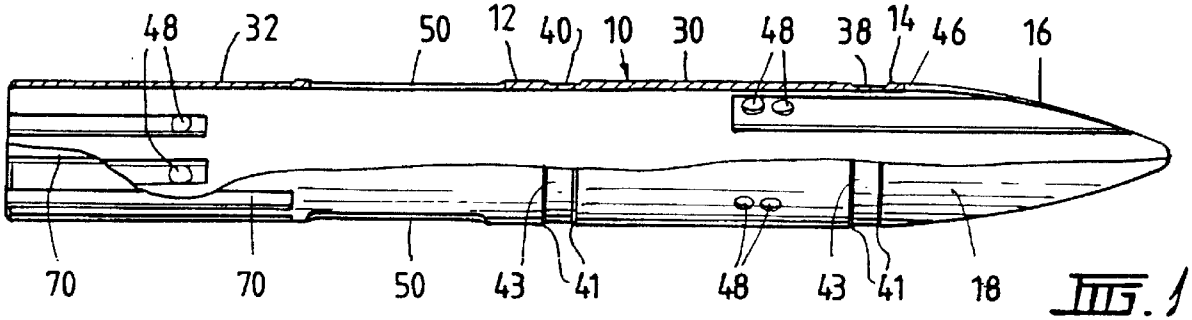
FIG. 1 is a longitudinal section view of the sleeve.
Figure 2:
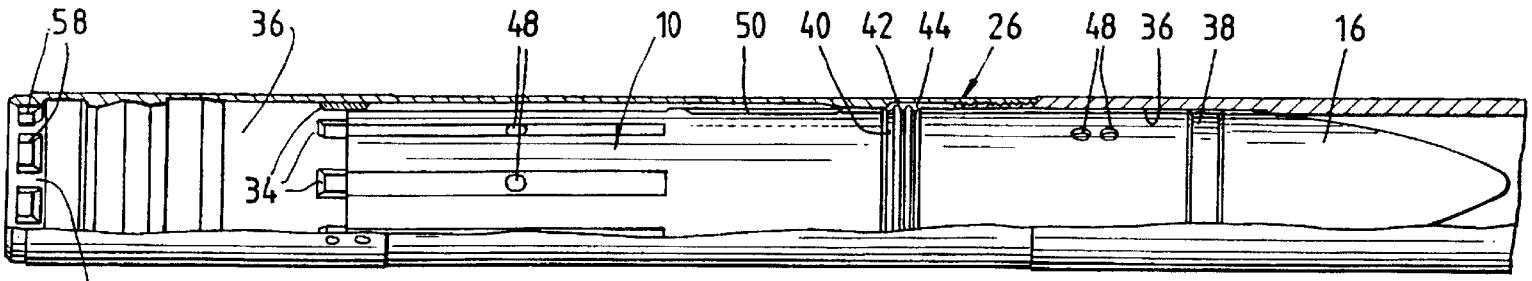
FIG. 2 is a longitudinal section view of the sleeve within a ground drill.
Figure 3:
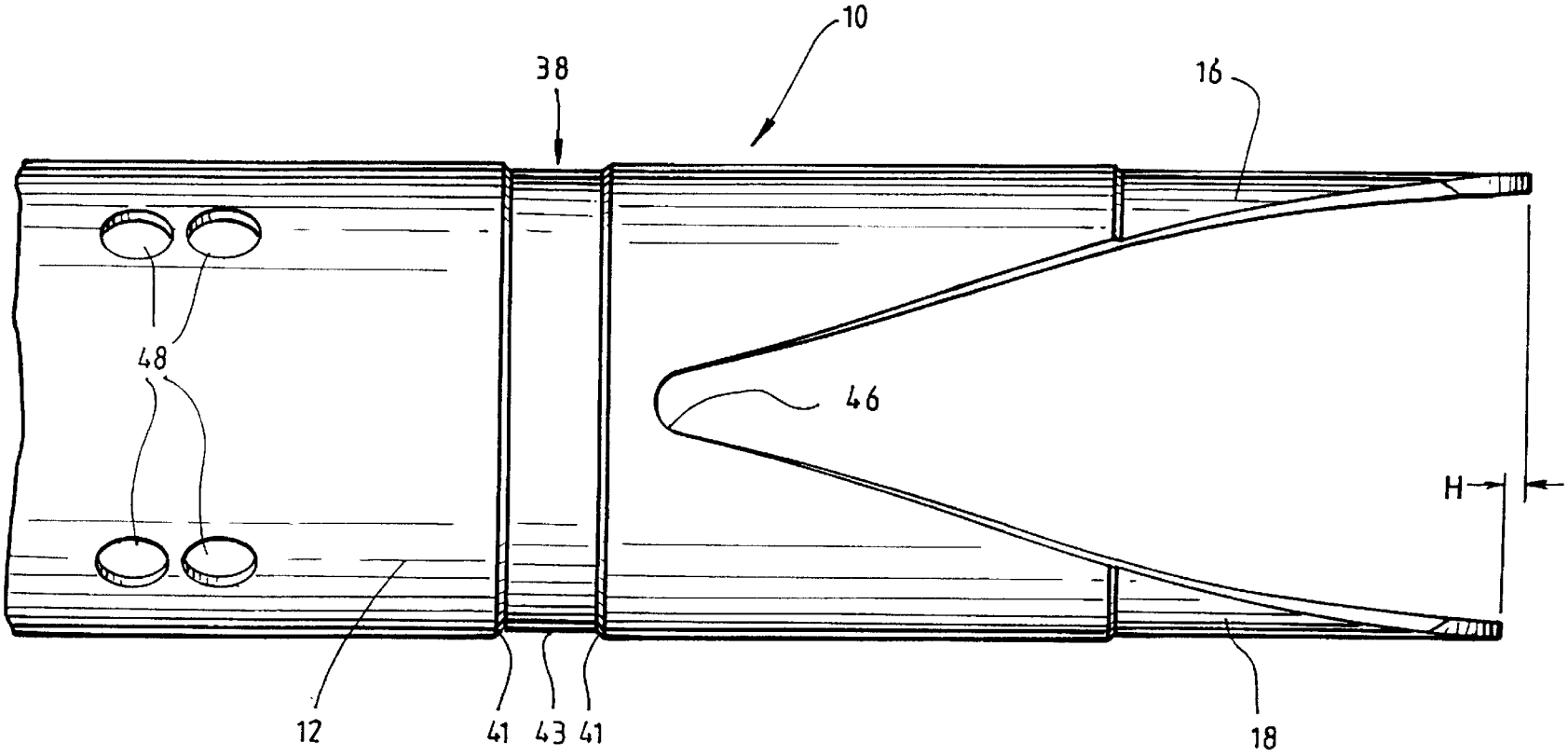
FIG. 3 is an enlarged side view of an upper end of the sleeve shown in FIGS. 1 and 2.

As shown in the accompanying drawings with particular reference to FIGS. 1 to 3, one embodiment of the sleeve 10 comprises a cylindrical member or tube 12 provided at one end 14 with a pair of opposing tapered peaks 16 and 18 which extend in the axial direction of the cylindrical tube 12.

Figure 4:
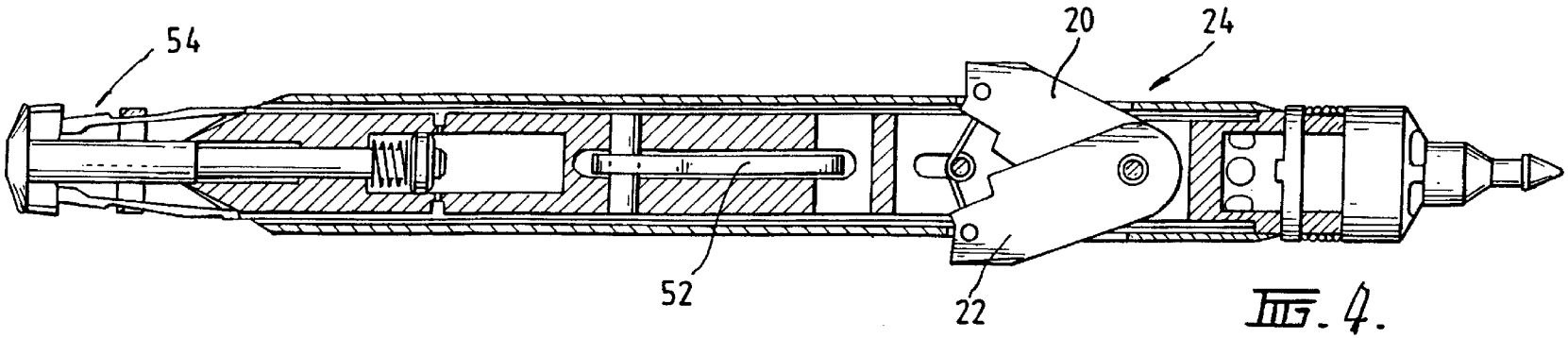
FIG. 4 is a longitudinal section view of a tool which can be orientated by said sleeve; and, FIGS. 5A to 5D are schematic top views of further embodiments of the sleeve.

The peaks are adapted to cooperate with abutment surfaces in the form of latch dogs 20 and 22 which are evenly spaced about and extend radially from a running tool 24 (refer FIG. 4). As seen in FIG. 2, the sleeve 10 is adapted for location within a tubular member in the form of a drive sub 26 of a ground drill (not shown). The sleeve 10 is allowed to move linearly along the drive sub 26 but is fixed against rotational motion. This is effected by way of guiding means which comprises a plurality of longitudinal channels 70 formed on the outer peripheral surface 30 of the sleeve 10 at its lower end 32; and, a plurality of rails or splines 34 which are formed on the inner circumferential surface 36 of the drive sub 26. The splines 34 reside in the channels 70 allowing axial movement of the sleeve 10 but preventing rotational movement.

The sleeve 10 also includes a releasable locking means for locking the sleeve in one of a plurality of linear positions relative to the drive sub 26. The releasable locking means comprises two spaced apart grooves 38 and 40 formed circumferentially about the outer circumferential surface 30. The grooves 38 and 40 are intended to cooperate with a radially resiliently expandable ring-like device such as snap ring 42 which is retained within a groove 44 provided in the inner circumferential surface 36 of drive sub 26. Sloping side surfaces 41 run from the outer peripheral surface 30 to the base or bottom 43 of each of the grooves 38 and 40 (refer FIG. 3). The snap-ring 42 is configured so that in a relaxed or non-expanded state, a part of the snap ring sits proud of the inner circumferential surface 36. When the sleeve 10 is in a position so that groove 40 coincides with groove 44, the snap ring 42 sits partially in both grooves thereby releasably locking the sleeve 10 in that position. However, as will be explained in greater detail below, the sleeve can be knocked from this position when impacted by the tool 24.

Each of the peaks 16 and 18 have a base of a width substantially equal to the angular spacing between the latch dogs 20 and 22 of the tool 24. Thus, in the present instance, the peaks 16 and 18 have a base of angular width of approximately (but slightly less than) 180°. In general terms, the number of peaks provided is dependent upon the number of peaks provided is dependent upon the number of latch dogs on the tool 24, although as shown hereinafter this need not necessarily be the case.

In order to overcome the deficiencies noted in the prior art, it is important that the peaks 16 and 18 be of different height. This is most clearly illustrated in FIG. 3 where it is shown that peak 16 is of a height (or length) H units greater than peak 18. By having the peaks at different height, it is impossible for both of the latch dogs 20 and 22 to simultaneously abut the very top of both peaks 16, 18. If for example latch dog 20 abuts the very top of peak 16, the tool 24 will commence rotating in one direction depending on which side of peak 16 the latch dog 20 slides. Accordingly by the time that the latch dog 22 reaches the same level as the top of peak 18 it is rotationally offset to a side of the peak 18 opposite the side of peak 16 along which the latch dog 20 slides.

A land 46 is provided at each side of the base of each peak for seating the latch dogs. The tool 10 is able to push the sleeve 10 in a downward direction by virtue of its momentum when the latch dogs 20 and 22 are seated in the lands 46.

The sleeve 10 is also provided with a plurality of through holes 48 disposed about its length to assist in the flow of drilling fluid through and about the sleeve 10 and drive sub 26. Also, a pair of longitudinally extending and diagonally opposed slots 50 are formed in the sleeve 10 to allow a further set of latch dogs 52 provided in the tool 24 (refer FIG. 4) to extend therethrough.

The operation and use of the sleeve 10 will now be described.

The sleeve 10 is disposed within the drive sub 26 in a first position in which the groove 40 coincides with groove 44 on a drive sub so that the snap ring 42 releasably latches the sleeve 10 in this position. The snap ring 42 prevents the sleeve 10 from moving from this position by the action of gravity.

The tool 24 may be typically loaded with a set of drill bit segments 54 for connection with a lower end of the drive sub 26. In order to facilitate such a connection, the drive sub 26 is provided with a plurality of seats 56 arranged between adjacent splines 58. When the tool 24 is lowered into the drive sub 26 it is critical that the bit segments 54 are aligned so as to be received by the seats 56. This alignment is achieved by the sleeve 10 and the latch dogs 20 and 22. Particularly, as the tool 24 is lowered into the drive sub, one of the latch dogs 20 or 22 will eventually contact the top or one side of peak 16 or 18. As the sleeve 10 is locked against rotational movement, this contact causes the tool 24 to rotate about its longitudinal axis which corresponds to the longitudinal axis of the drive sub 26. This rotation continues until the latch dogs 20 and 22 contact respective lands 46. The tool 24 is now correctly aligned so that the bit segments 54 can be received directly into the seats 56.

Due to the momentum of the tool 24, when the latch dogs 20 and 22 strike the lands 46, they apply downward force to the sleeve 10. This force is sufficient so as to cause the radial expansion of the snap ring 42 as it rides up on the sloping side of surface 41 of the groove 40.

The sleeve 10 is moved downwardly to a position where the groove 38 coincides with the groove 44 at which time the snap ring 42 snaps back (ie. contacts in a radial direction) so as to sit partially within both grooves 44 and 38 thereby again releasably locking the sleeve 10 in position. At this time, the bit segments 54 are locked in the seats 56 by the outer circumferential surface of the sleeve 10.

It will be appreciated, as explained above, that in the present embodiment, the possibility of the tool 24 jamming with the sleeve 10 is substantially eliminated due to the peaks 16 and 18 having a different height.

Figure 5A:
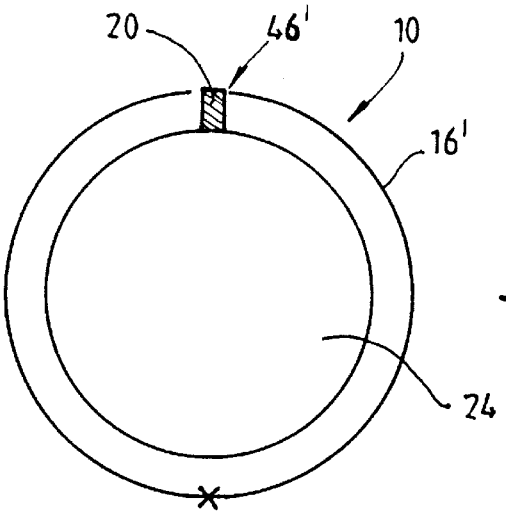

FIGS. 5A–5D show in schematic form a top view of different embodiments of the sleeve 10. In FIG. 5A, the sleeve 10 is provided with a single peak 16' and tool 24 with a single latch dog 20. The peak 16' has an angular width of substantially 360°. Land 46' of the peak 16' is shown as a gap in which the latch dog 20 resides. For ease of understanding, the top or end of peak 16' is shown marked with an X. Indeed, in all of FIGS. 5A–5D, the top or end of the peaks shown is represented by an X. Returning to the embodiment in FIG. 5A, it can be seen that jamming of the latch dog 20 with the peak 16' is impossible as the peak 16' is the one and only peak of the sleeve 10. Nevertheless, this embodiment is not considered to be the most preferred as the tool 24 is likely to be disposed in a position inclined from a longitudinal axis of the sleeve 10 and drive sub 26 and accordingly contact unnecessarily and undesirably against the inner surfaces of the sleeve 10 and/or drive sub 26.

Figure 5B:
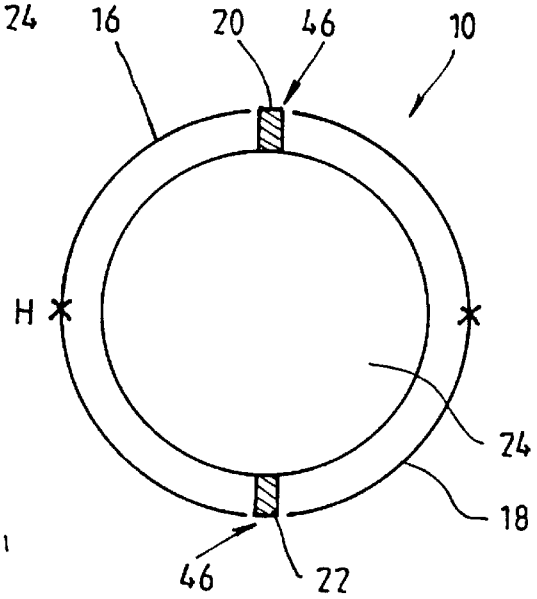

The embodiment shown in FIG. 5B is identical to that shown in FIGS. 1–3. The tops X of the peaks 16 and 18 are at different levels with the highest peak 16 being designate with the character H. It will be appreciated however, in this embodiment that one of peaks 16 or 18 can be removed and the tool 24 will still reside in one of the two angular positions that it must assume if both peaks 16 and 18 were present.

Figure 5C:
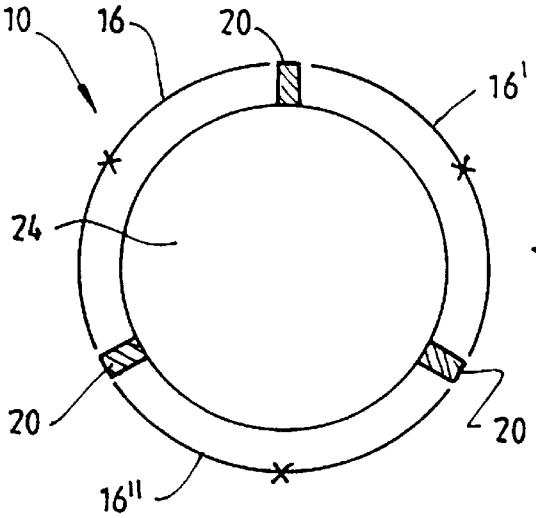

In FIG. 5C, the tool 24 is provided with three evenly spaced latch dogs 20 and the sleeve 10 provided with three peaks 16, 16' and 16". The angular width of each of the three peaks is approximately the same as the angular distance between adjacent latch dogs 20, ie. slightly less than 120° to allow for the provision on the lands 46. Again, the sleeve 10 in FIG. 5C will correctly orient the tool 24 in one of the three positions it can assume irrespective of whether it has only one or two of the three peaks provided the peaks are of an angular width substantially identical to the angular spacing between the latch dogs 20. Further, to avoid the possibility of jamming as in the prior art, it is again necessary that one of the peaks 16, 16', 16" is higher than the other peaks.

Figure 5D:
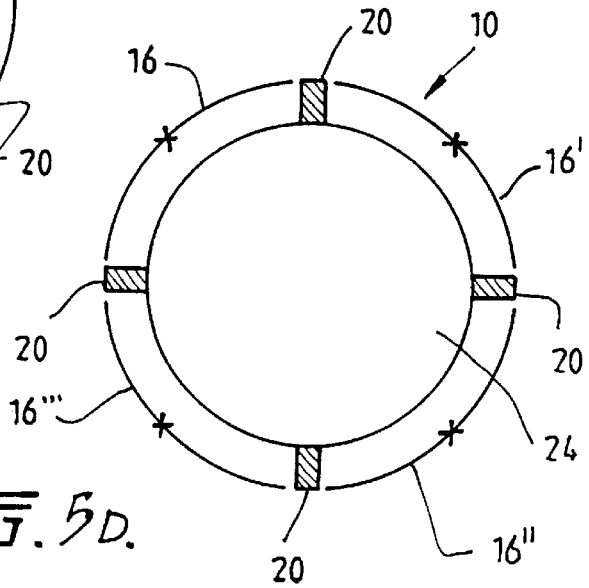

A further variation is shown in FIG. 5D in which the tool 24 is provided with four evenly spaced latch dogs 20 and the sleeve 20 with four evenly spaced peaks 16, 16' 16" and 16'". The angular width of each of the peaks in this embodiment is slightly less than 90°, being substantially the same as the angular distance between adjacent latch dogs 20. Again it is important that one of the peaks be higher than the remaining peaks. Further, it will be appreciated that the sleeve 10 in this embodiment will correctly orientate the tool 24 in one of its four possible angular positions irrespective of whether or not the sleeve contains one, two, three or four peaks.

As is apparent particularly from the embodiments in FIGS. 5B–5D, the latch dogs 20 contact or slide down the distant sides of adjacent peaks. Or, in other words, at least when the number of peaks is the same as (or greater than) the number of latch dogs 20, adjacent latch dogs are spaced by one (or more) peaks.

For the sake of symmetry and balance it is preferred in all of the embodiments that the number of peaks equals the number of latch dogs. However, as explained above, this is not an absolute requirement to correctly orientate the tool 24.

Now that embodiments of the invention has been described in detail, it will be apparent to those skilled in the relevant arts that numerous modifications and variations may be made without departing from the basic inventive concepts. For example, while the releasable locking means is shown as comprising two grooves 38 and 40 formed on the outer circumferential surface of the sleeve 10, any number of grooves can be used depending on the desired locations at which the sleeve 10 is to be locked. Also, the grooves in the sleeve and drive sub can be interchanged so that the snap ring 42 is retained about the sleeve 10 in a square sided groove and the drive sub provided with a number of sloping sided grooves for receiving the snap ring 42. Further, although the present invention is described with reference to the drilling industry, it can of course be used in other applications where it is required to angularly orientate one part of a system relative to another. All such modifications and variations are deemed to be within the scope of the present invention, the nature of which is to be determined from the foregoing description and the appended claims.

What is claimed is:

1. A sleeve for orientating a tool provided with at least one abutment surface, said sleeve comprising:

a substantially cylindrical member provided at one end with two or more tapered peaks extending in the axial direction of said cylindrical member with one of the peaks being a highest peak extending furthest in the axial direction;

said substantially cylindrical member having an interior shaped to receive therein the tool travelling axially with respect to the sleeve;

said highest peak having sides sloped to slidably contact the at least one abutment surface of the tool as the tool travels through the interior of said substantially cylindrical member, forcing the tool to rotate about a longitudinal axis of said substantially cylindrical member to orientate said tool into one of one or more predetermined rotational positions; and wherein said two or more tapered peaks are circumferentially spaced such that, when the at least one abutment surface contacts and slides along one of said sides of said highest peak, any other abutment surface of the tool contacts respective others of said tapered peaks on a side distant said one of said sides.

2. A sleeve according to claim 1, further comprising a land formed at a lowest point of each of said peaks, each of said lands being configured to receive respective ones of said abutment surfaces.

3. A sleeve according to claim 2, wherein said lowest points are at the same level.

4. A sleeve according to claim 1, where in said sleeve is retainable within a tubular member through which said tool can travel.

5. A sleeve according to claim 4, further comprising guiding means for guiding said sleeve to move linearly in the direction of said longitudinal axis of said tubular member while preventing rotation of said sleeve relative to said tubular member.

6. A sleeve according to claim 5, wherein said guide means comprises one of: a rail formed on an outer peripheral surface of said sleeve and configured to engage a complementary channel; and a channel formed on an outer peripheral surface of said sleeve and configured to engage a complementary rail.

7. A sleeve according to claim 6, fiber comprising releasable locking means for releasably locking said sleeve in at least one position relative to said tubular member so as to resist movement of said sleeve in an axial direction away from said at least one position.

8. A sleeve according to claim 7, wherein said releasable locking means comprises at least one groove formed circumferentially about an outer circumferential surface of the sleeve and a radially resiliently expandable ring-like device retainable in a circumferential groove formed in an inner circumferential surface of the tubular member, said ring-like device configured to sit proud on said inner circumferential surface when in a relaxed state;

wherein, when said sleeve is moved linearly to a position wherein one of the grooves on the sleeve coincides with the groove on the tubular member, said ring-like device is partially seated in both grooves thereby locking said sleeve in said position.

9. A sleeve according to claim 8, wherein each of the grooves on said sleeve is provided with sloping side surfaces leading from said outer peripheral surface to a base of said groove so that when said tool impacts on said sleeve, said ring-like device can be progressively expanded by said sloping side surfaces so that said ring-like device is moved out of said groove in said sleeve allowing said sleeve to move linearly along said tubular member.

10. The sleeve according to claim 9, wherein the groove in said tubular member has square or stepped sides to prevent the escape of said ring-like device therefrom.

11. A sleeve according to claim 1, wherein the number of peaks is the same as the number of abutment surfaces on the tool.

12. A sleeve for orientating a tool provided with at least one abutment surface, said sleeve comprising:

a substantially cylindrical member provided at one end with two or more tapered peaks extending in the axial direction of said cylindrical member with one of the peaks being a highest peak extending furthest in the axial direction;

said substantially cylindrical member having an interior shaped to receive therein the tool travelling axially with respect to the sleeve; and a land formed at a lowest point of each of said peaks, each land being configured to receive an abutment surface of the tool, the circumferential position of each land corresponding to a predetermined rotational position.

13. The sleeve according to claim 12, wherein said lowest points are at the same level.

14. A sleeve for orientating a tool travelling through said sleeve into one of one or more predetermined rotational positions, the tool provided with at least one abutment surface, said sleeve being retainable within a tubular member through which said tool can travel, said sleeve comprising:

a substantially cylindrical member provided at one end with two or more tapered peaks extending in the axial direction of said cylindrical member with one of the peaks being the highest of all the peaks, each of said two or more tapered peaks being configured to engage an abutment surface of the tool; and guiding means for guiding said sleeve to move linearly in the direction of a longitudinal axis of said tubular member while preventing rotation of said sleeve relative to said tubular member.

15. The sleeve according to claim 14, wherein said guide means comprises one of:

a rail formed on an outer peripheral surface of said sleeve and configured to engage a complementary channel; and a channel formed on an outer peripheral surface of said sleeve and configured to engage a complementary rail.

16. The sleeve according to claim 15, further comprising a releasable lock that releasably locks said sleeve in at least one position relative to said tubular member so as to resist movement of said sleeve in an axial direction away from said at least one position.

17. The sleeve according to claim 16, wherein said releasable lock comprises at least one groove formed circumferentially about an outer circumferential surface of the sleeve and a radially resiliently expandable ring-like device retainable in a circumferential groove formed in an inner circumferential surface of the tubular member, said ring-like device configured to sit proud on said inner circumferential surface when in a relaxed state;

wherein, when said sleeve is moved linearly to a position wherein one of the grooves on the sleeve coincides with the groove on the tubular member, said ring-like device is partially seated in both grooves thereby locking said sleeve in said position.

18. The sleeve according to claim 17, wherein each of the grooves on said sleeve is provided with sloping side surfaces leading from said outer peripheral surface to a base of said groove so that when said tool impacts on said sleeve, said ring-like device can be progressively expanded by said sloping side surfaces so that said ring-like device is moved out of said groove in said sleeve allowing said sleeve to move linearly along said tubular member.

19. The sleeve according to claim 18, wherein the groove in said tubular member has square or stepped sides to prevent the escape of said ring-like device therefrom.

20. A sleeve for orientating a tool provided with one or more abutment surfaces, said sleeve comprising:

a substantially cylindrical member provided at one end with two or more tapered peaks extending in the same axial direction of said cylindrical member with one of the peaks being a highest peak extending furthest in the axial direction, each of said two or more tapered peaks being configured to engage an abutment surface of the tool, wherein the number of peaks is the same as the number of abutment surfaces on the tool; and wherein said substantially cylindrical member has an interior shaped to receive therein the tool travelling axially with respect to the sleeve.

* * * * *